United States Patent [19]

Berchem

[11] Patent Number: 4,644,776

[45] Date of Patent: Feb. 24, 1987

[54] METHOD OF MAKING A LOW-ALLOY FORGING

[75] Inventor: Rütger Berchem, Gelsenkirchen, Fed. Rep. of Germany

[73] Assignee: Berchem & Schaberg GmbH, Gelsenkirchen, Fed. Rep. of Germany

[21] Appl. No.: 809,836

[22] Filed: Dec. 11, 1985

Related U.S. Application Data

[63] Continuation of Ser. No. 633,184, Jul. 23, 1984, abandoned.

[30] Foreign Application Priority Data

Jul. 23, 1983 [DE] Fed. Rep. of Germany ..... 3326642

[51] Int. Cl.[4] ..... B21J 1/06

[52] U.S. Cl. ..... 72/364; 148/12 F

[58] Field of Search ..... 72/364, 700; 148/12 F

[56] References Cited

U.S. PATENT DOCUMENTS 3,055,104 9/1962 Lyon ..... 72/700

3,066,408 12/1962 Fader ..... 72/700

4,222,257 9/1980 Theis et al. ..... 72/700

4,419,152 12/1983 Grilli et al. ..... 148/12 F

FOREIGN PATENT DOCUMENTS 21006 5/1974 Japan ..... 72/364

OTHER PUBLICATIONS

American Society for Metals, *Metals Handbook* 8th ed., vol. 1, Properties and Selection of Metals, p. 424.

"Eine Einmalige Hitze Genügt" by Berchem and Wilkus, published in Konstruktion & Design, Feb. 1983, pp. 32–35.

*Primary Examiner*—Lowell A. Larson

*Attorney, Agent, or Firm*—Karl F. Ross; Herbert Dubno

[57] ABSTRACT

A forging method to obtain increased elastic limit without detriment to the elongation and the tensile strength in which a low-alloy steel with up to 0.6% carbon is subjected to forging and the entire forging operation or at least the last forging stage is effected at a temperature up to 1060° C., any earlier forging steps being carried out at temperatures above 1100° C. and up to 1250° C.

2 Claims, No Drawings

METHOD OF MAKING A LOW-ALLOY FORGING

This is a continuation of co-pending application Ser. No. 633,184, filed on July 23, 1984, now abandoned.

FIELD OF THE INVENTION

My present invention relates to a method of making a forging, especially a drop forging, utilizing low-alloy steel with a carbon content of less than 0.6%.

BACKGROUND OF THE INVENTION

The fabrication of drop-forged articles of low-alloy steel having a carbon content of less than 0.6% has been proposed heretofore in the art and in such processes, a steel blank is heated to a temperature above the $A_{C3}$ point, subjected to forging and controllingly cooled. With respect to the forging step, this generally is carried out with a degree of forging of 10 to 80% or more. The shape change in percentage form during forging is the ratio of the cross section of respective surfaces in the working direction before and after forming, i.e. forging.

Controlled cooling, of course, refers to the cooling down of the forging following the forging operation from the forging heat (see Berchem and Wilkus "Eine Einmalige Hitze Genugt" in *Konstruktion & Design,* Feb. 1983, P. 32–35).

The cooling speed depends basically upon the selected alloying components and their proportions.

The prevailing thinking in the field is that the steels should be heated to forging temperatures which invariably lie above 1100° C.

The desired mechanical properties (tensile strength, elongation to break, elastic limit or yield point) can be varied by variation of the cooling velocity. However for a given alloy steel it is not possible to exceed a given yield point without detrimentally affecting the tensile strength and/or the elongation to break. The type of steel which falls under the aforedescribed definitions is, for example, the material identified under German Federal Republic standards as C38BY.

For this material and for other low-alloy steels having a carbon content less than 0.6%, it is highly desirable to have high yield points or elastic limits without detrimental effect upon tensile strength or the elongation to break and this has not been possible heretofore.

OBJECTS OF THE INVENTION

It is the principal object of the present invention to provide an improved method of forging low-alloy steels of the type described whereby disadvantages of earlier methods are obviated.

Another object of this invention is to provide a method of forging such steels which allows for an increase in the yield point or elastic limit without detrimental effect upon the tensile strength or elongation to break.

SUMMARY OF THE INVENTION

These objects and others which will become apparent hereinafter are attained, in accordance with the invention in which at least 10% of the shape change during forging is carried out at a reduced forging temperature, namely a forging temperature of 1060° C. or less, and after this form change at the reduced forging temperature, the controlled cooling (op. cit.) is carried out.

In other words, the shape change during forging which can be represented by the ratio of the areas in the forming direction before and after forging can amount to 10 to 80% or more, and of this shape change at least 10% is carried out during the final stage of forging and before the controlled cooling at a temperature of 1060° C. or less.

The entire forging operation can be carried out in a single forging step and in that case, all of the forging is carried out at the reduced forging temperature.

When forging is carried out in n forging steps, where n is at least 2, the starting temperature for the forging operation and the forging temperature during the steps are established so that n-1 forging steps are carried out at a temperature of more than 1060° C., the last of these steps bringing the temperature to 1060° C. or below, and at least the $n^{th}$ forging step is effected so that it carries out 10% of the forming during forging.

Where n=2 and a two-stage process is carried out, the second stage is accomplished at the reduced forging temperature with the aforementioned degree of forging.

When n forging stages are utilized, a single heat can be employed for all of these stages, although for a multiple-stage process where only the last group of stages is to be carried out at the reduced temperature, the intervening heatings may be employed. The invention has been found to be most effective for the low-alloy carbon steel C38BY having a carbon content of less than 0.6%. The forging stages prior to the reduced temperature forging are carried out at temperatures above 1100° C.

While the preferred steel is the C38BY mentioned previously, I have found that the method of the invention improves forging of all low-alloy steels by increasing the elastic limit. The reason for this is not fully understood but appears to result from some unique properties which are created by the low-temperature drop-forging operation when it is carried out to an extent of at least 10% of the forging shape change to be imparted to the bloom or blank. Microalloy steels can be used to achieve even higher yield points or elastic limits and indeed the yield point or elastic limit which can be obtained even without microalloying is equal or close to that which has been obtained heretofore with microalloy steels. Consequently, in most cases the preferred steel will be a steel having a carbon content up to 0.6% by weight and even free from the microalloying components vanadium or rare earths, but of course, including the elements unavoidable in such carbon steels.

SPECIFIC EXAMPLE

Highly stressed automotive vehicle parts are forged from C38BY steel and require certain properties as follows:

Tensile strength=620 to 800 N/mm$^2$.

Elongation to break $A_5$=at least 18.0%.

Elastic limit $R_{p0.2}$=at least 420 N/mm$^2$.

A bloom of this material is classically subjected to forging with a specific cross section change of a total of 120% and the properties of the forged articles were tested and found to be:

Tensile strength=734 N/mm$^2$.

Elongation to break $A_5$=20.7%.

Yield point $R_{p0.2}$=398 N/mm$^2$.

Tests showed that significantly higher tensile strengths above 730 N/mm$^2$ could not be obtained for equivalent elongations and that the yield point was below the desired value. Changes in the cooling conditions did not overcome this problem.

When identical forging was carried out except that the method of the invention was followed, the tensile strength was 748 $N/mm^2$, the elongation to break $A_5$ was 22.8% and the elastic limit $R_{po.2}$ was 454 $N/mm^2$.

In all cases the forging starting temperature of 1250° C. was generated by inductively heating the blooms which were subjected to preforging working operations in six stages of rolling and bending.

The articles were then drop forged and the comparative tests were all carried out with drop forging at temperatures above 1100° C. The articles according to the invention were permitted to cool to a temperature just below 1060° C. for the last 10% of the forging to the desired shapes. All were then permitted to cool by the identical controlled cooling steps (op. cit.).

Tests on low-alloy steels with carbon contents up to 0.6% and the usual elements associated with such steels showed essentially the same grain structure upon forging with the reduced forging temperature for a minimum of 10% of the forging shape change, all demonstrating improved values for the yield point without detrimentally affecting the tensile strength or the elongation to break.

I claim:

1. In a method of forging a low-alloy steel workpiece having a carbon content below 0.6% and consisting of a microalloy steel in which the workpiece is heated to a temperature above the $A_{C3}$ point and is subjected to forging in at least one step to effect a shape change as measured by the ratios of cross sections in the forging direction of 10 to 80%, the improvement wherein at least 10% of the shape change is effected at a reduced forging temperature of at most 1060° C. and the workpiece is thereafter subjected to controlled cooling, forging of the workpiece being effected in n forging steps, wherein n is at least 2 and the initial forging temperature is selected so that n−1 forging steps are effected at a forging temperature in excess of 1060° C. and the $n\text{-}1^{th}$ step is carried out so that the temperature following the $n-1^{th}$ step is at most 1060° C. and the $n^{th}$ forging step effects at least 10% of the shape change during forging.

2. In a method of forging a low-alloy steel workpiece, said workpiece comprising steel with a carbon content below 0.6% and free from the microalloying components of vanadium or rare earth elements, in which method the workpiece is heated to a temperature above the $A_{C3}$ point and is subjected to forging in at least one step to effect a shape change as measured by the ratios of cross sections in the forging direction of 10 to 80%, the improvement wherein at least 10% of the shape change is effected at a reduced forging temperature of at most 1060° C. and the workpiece is thereafter subjected to controlled cooling, forging of the workpiece being effected in n forging steps, wherein n is at least 2 and the initial forging temperature is selected so that n−1 forging steps are effected at a forging temperature in excess of 1060° C. and the $n-1^{th}$ step is carried out so that the temperature following the $n-1^{th}$ step is at most 1060° C. and the $n^{th}$ forging step effects at least 10% of the shape change during forging.

* * * * *